United States Patent [19]

Phillips

[11] Patent Number: 4,793,315

[45] Date of Patent: Dec. 27, 1988

[54] FUEL PUMPING APPARATUS

[75] Inventor: Ronald Phillips, Northolt, England

[73] Assignee: Lucas Industries, Birmingham, England

[21] Appl. No.: 753,431

[22] Filed: Jul. 10, 1985

[30] Foreign Application Priority Data

Jul. 13, 1984 [GB] United Kingdom ..... 8417864

[51] Int. Cl.[4] ..... F02M 39/00

[52] U.S. Cl. ..... 123/506; 123/458; 251/30.01

[58] Field of Search ..... 123/458, 506, 500, 501, 123/455; 251/30.01, 30.05, 63.4

[56] References Cited

U.S. PATENT DOCUMENTS

| | | | |
|---|---|---|---|
| 3,294,120 | 12/1966 | Roohser | 251/63.4 |
| 3,904,167 | 9/1975 | Touch | 251/30 |
| 4,333,492 | 6/1982 | West | 137/119 |
| 4,385,614 | 5/1983 | Eheim | 123/506 |
| 4,418,670 | 12/1983 | Lakin | 123/446 |
| 4,459,963 | 7/1984 | Gross | 123/458 |
| 4,501,406 | 2/1985 | Walther | 251/30.01 |
| 4,546,749 | 10/1985 | Igashira | 123/506 |

FOREIGN PATENT DOCUMENTS

| | | | |
|---|---|---|---|
| 0128428 | 8/1983 | Japan | 123/506 |
| 2004943 | 4/1979 | United Kingdom | 123/506 |
| 2009842 | 6/1979 | United Kingdom | 123/506 |

*Primary Examiner*—Carl Stuart Miller

[57] ABSTRACT

A fuel pumping apparatus for supplying fuel to an internal combustion engine includes a plunger reciprocable within a bore having an outlet connected to an injection nozzle. The plunger is reciprocated through a fixed stroke and a valve is provided to close a spill path to start delivery of fuel to the nozzle. A movable piston controlled by an electrically operable valve, is allowed to move to absorb the fuel displaced by the plunger to halt fuel delivery to the nozzle.

5 Claims, 3 Drawing Sheets

FUEL PUMPING APPARATUS

This invention relates to a fuel pumping apparatus for supplying fuel to an internal combustion engine, the apparatus being of the kind comprising a reciprocable plunger pump arranged in use, to be driven in timed relationship with the associated engine, and means for controlling the amount of fuel delivered by the apparatus through an outlet, to the engine during inward movement of the plunger.

In our co-pending British application No. 8503787 there is described a fuel pumping apparatus in which the amount of fuel which is delivered through the outlet is controlled by absorbing a variable quantity of fuel after the start of fuel delivery through the outlet. With this form of apparatus the start of delivery of fuel occurs either as soon as the pumping plunger starts to move inwardly or at some predetermined position of the plunger during its inward movement when it covers a port formed in the wall of the cylinder in which it is located.

It is desirable to be able to alter the timing of the start of fuel delivery through the outlet to an associated engine in order to take into account various engine operating parameters and the object of the invention is to provide a fuel pumping apparatus of the kind specified in a simple and convenient form.

According to the invention a fuel pumping apparatus for supplying fuel to an internal combustion engine comprises a reciprocable plunger pump operable in use to deliver fuel in timed relationship with the associated engine, a chamber communicating with a pumping chamber of the pump, a bore opening into said chamber and a piston member slidable in the bore, an outlet through which fuel displaced from the pumping chamber can flow to the associated engine, resilient means biasing the piston towards an end wall of the chamber, a recess defined between said end wall and the end of said piston when the latter is in contact with the end wall, first electrically operable means operable to place said recess in communication with said chamber thereby to allow the pressure of fuel in said chamber to drive the piston out of said chamber, valve means for controlling the escape of fuel from said chamber, and second electrically operable means for controlling the operation of said valve means, the arrangement being such that at the start of a delivery stroke of said pumping plunger, said piston will be in contact with said end wall and said valve means will be open, closure of said valve means will cause delivery of fuel through the outlet and later operation of said first electrically operated means will allow outward movement of the piston the piston movement absorbing further fuel displaced by the plunger.

Figure 1:
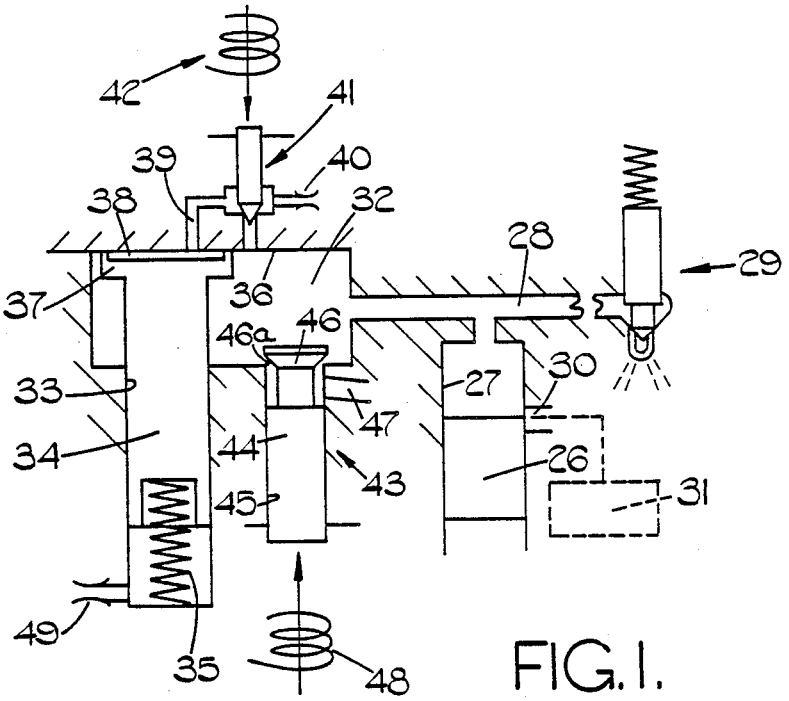
Figure 2:
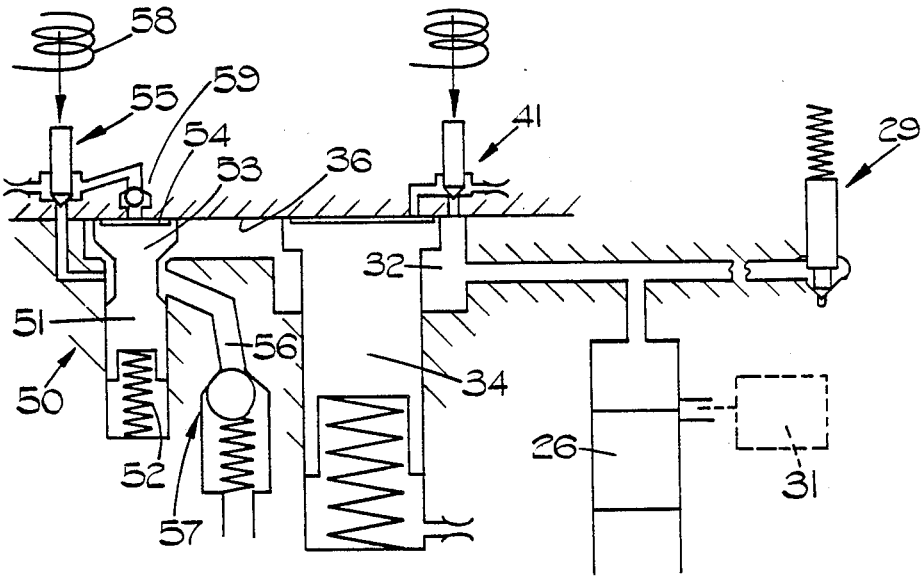
Figure 3:
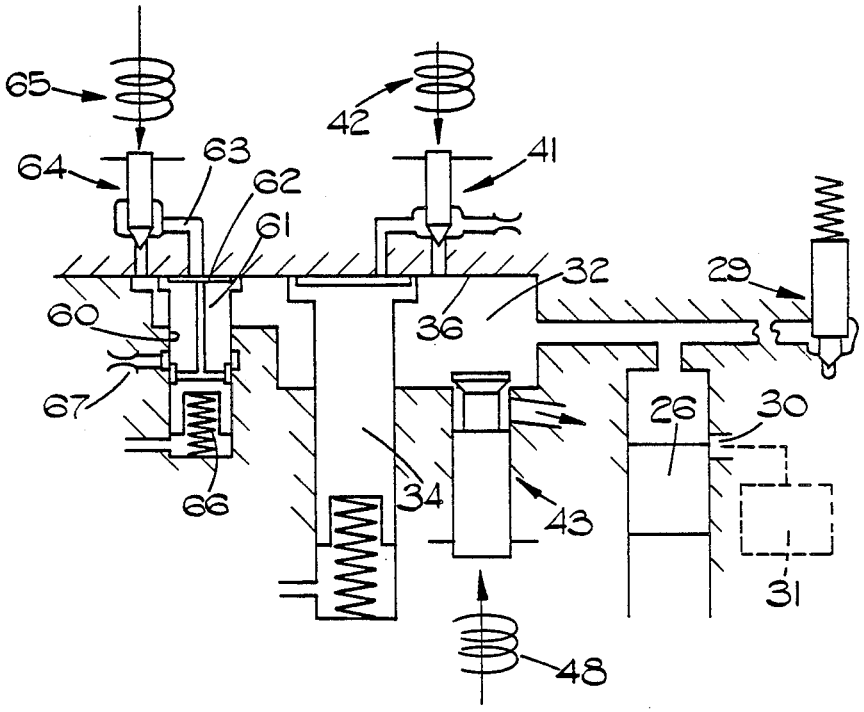
Figure 4:
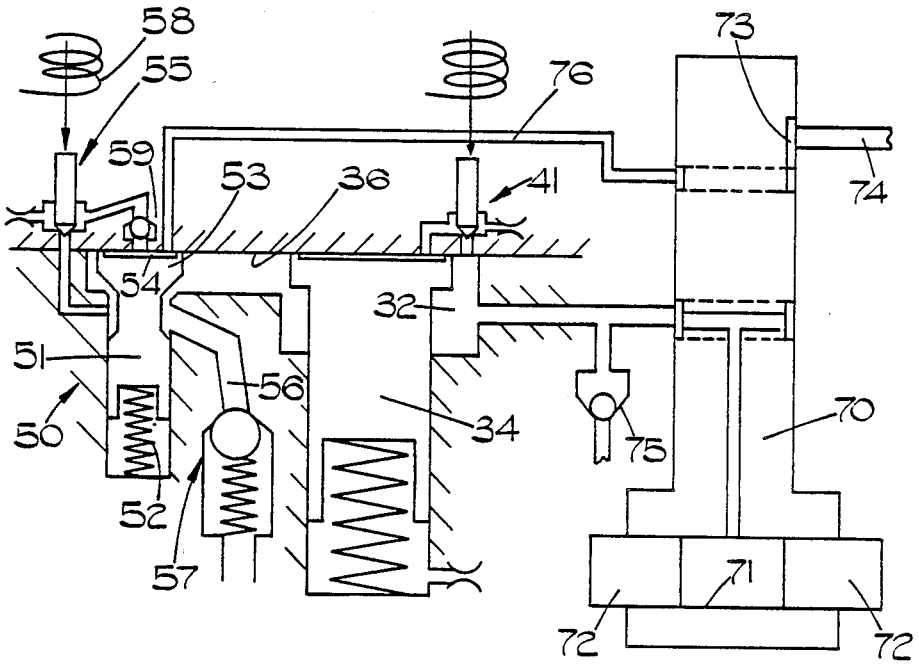

In the accompanying drawings:

FIG. 1 is a diagrammatic view of one example of an apparatus in accordance with the invention, FIG. 2 shows another example of an apparatus in accordance with the invention, FIG. 3 shows the apparatus of FIG. 1 modified to provide pilot injection of fuel, and FIG. 4 is a modification of the apparatus shown in FIG. 2.

Referring to FIG. 1 of the drawings the apparatus includes a reciprocable plunger 26 slidable within a bore 27, the plunger and bore defining a pumping chamber which is connected through an outlet 28 to a fuel injection nozzle 29 of an associated engine, the fuel injection nozzle incorporating the usual spring loaded fuel pressure operable valve.

Formed in the wall of the bore 27 is an inlet port 30 which is connected to a source 31 of fuel at low pressure and the port 30 is positioned to be covered by the plunger shortly after the inward movement of the plunger has commenced.

The aforesaid pumping chamber also communicates with a chamber 32 into which opens a bore 33 in which is located a piston 34, the piston being biased by a spring 35 towards an end wall 36 of the chamber. The piston 34 has a head 37 of enlarged diameter and in the face of the head presented to the end wall 36 there is formed a recess 38. When the piston head 37 is in contact with the aforesaid end wall, the recess 38 by way of a passage 39 formed in the end wall, communicates with a drain by way of a restriction 40 and when during inward movement of the plunger 26, the port 30 is closed, the pressurised fuel in the pumping chamber will be communicated to the chamber 32 but will retain the head 37 in contact with the end wall 36. In order to allow the piston 34 to move outwardly under the influence of the fuel pressure in the chamber 32, a valve 41 is opened which communicates the pressure in the chamber 32 with the recess 38. As soon as this occurs the fuel pressure acting on the piston urges the piston outwardly against the action of the spring and the effect of this is to absorb the fuel delivered by the plunger by increasing the volume of the chamber 32 thereby resulting in a lowering of the pressure in the chamber 32 and the outlet 28. The pressure is lowered sufficiently to allow the valve in the nozzle 29 to close so that the supply of fuel to the associated engine ceases. The displacement of the piston 34 must be sufficient to absorb the fuel displaced from the pumping chamber. The valve 11 includes a valve member which is urged to the closed position i.e. to prevent the fuel under pressure in the chamber 32 reaching the recess, b energising a solenoid 42. De-energising the solenoid 42 permits the valve member to move to the open position and it will be seen that the valve member is subject to the pressure in the chamber 32 so that such movement takes place very quickly.

For the purpose of controlling the timing of the start of delivery of fuel to the associated engine, there is provided a spill valve generally indicated at 43. The spill valve includes a valve member 44 slidably accommodated within a bore 45 opening into the chamber 32 and the valve member has a head 46 which is located within the chamber and which can make sealing engagement with a seating 46A defined about the bore 45. Beneath the head 46 the valve member is of reduced diameter and the annular space thus defined is connected to a spill passage 47 which may return fuel to the source 31. The valve member 44 is retained in the open position by energising a solenoid 48.

In operation towards the end of the outward movement of the pumping plunger 26, the solenoids 42 and 48 are energised thereby closing the valve 41 and moving the valve 43 to the open position. Moreover, because of the reduced pressure in the chamber 32 which in fact may be the pressure of fuel delivered by the source 31, the piston 34 will have been urged into contact with the end wall 36 by the action of the spring 35. When the plunger 26 starts to move inwardly fuel will initially be displaced probably through the port 30 but as soon as this port is covered, the fuel will be displaced from the pumping chamber and will flow past the head 46 of the valve 43 and along the spill passage 47. When it is required that delivery of fuel should commence, the solenoid 48 is de-energised and the fuel pressure in the chamber 32 quickly closes the head 46 onto its seating. Rapid movement of the valve member can be ensured by suitable choice of the clearance between the valve head 46 and the seating so that the pressure in the chamber 32 will be above that of the source 31 but clearly below that required to open the valve of the injection nozzle.

With the spill valve closed delivery of fuel takes place as described and termination of the delivery of fuel is effected by de-energising the solenoid 42 to allow the valve 41 to open thereby to unbalance the piston 34 so that its movement out of the chamber absorbs the remaining quantity of fuel displaced by the pumping plunger 26. The rate of movement of the piston 34 can be controlled by means of a restriction 49 and this can act to damp the movement of the piston so as to minimise the possibility of oscillation occurring.

The apparatus which is shown in FIG. 2 functions in the same manner so far as fuel, timing and quantity control are concerned. However, the spill valve 50 has a slightly different construction. The valve member 51 of the valve is biased to the open position by means of a spring 52 and as with the piston 34, the head 53 of the spill valve is provided with a recess 54 which can be connected by means of a solenoid operated valve 55 to the annular space defined between the reduced portion of the valve member lying beneath the head 53, and the wall of the bore in which the valve member is located. This space is connected to a spill passage 56 but a pressurising valve 57 is provided in the spill passage. The valve 55 is held in its closed position, by energising a solenoid 58 and in the closed position and with the valve head 53 in contact with the end wall 36 of the chamber 32, the recess 54 is connected to a low pressure which is below that in the chamber 32, by way of a restrictor. During the initial inward movement of the pumping plunger 26, the pressure in the chamber 32 rises to that determined by the pressurising valve 57 and when delivery of fuel is required, the valve 55 is opened by de-energising the solenoid 58, to place the recess 54 in communication with the aforesaid annular space about the valve member, which space at that time is in direct communication with the chamber 32. The pressure in the recess 54 therefore rises to the pressure in the space 32 and the valve member 51 is moved b the pressure to the closed position against the action of the spring 5.. The pressure in the chamber 32 therefore rises since spillage of fuel is prevented, until the valve member in the injection nozzle is opened and delivery of fuel takes place as described. In order to prevent escape of fuel at high pressure by way of the valve 55, a simple non-return valve 59 is provided the valve 59 being positioned in front of the valve 55 which therefore during delivery of fuel, does not experience the high pressure of fuel which is developed by the apparatus.

Turning now to FIG. 3, this shows an apparatus the majority of the components of which are identical to those of FIG. 1. However, the apparatus provides an additional facility namely the possibility of having so-called pilot injection of fuel in which a small pilot quantity of fuel is delivered through the injection nozzle 29 before the main quantity of fuel. The end of fuel delivery to the engine is controlled in exactly the same way as in FIG. 1, by de-energising the solenoid 42 and the start of fuel delivery by de-energising the solenoid 48. Following the rise in pressure in the chamber 32 to a level sufficient to open the valve in the injection nozzle and allow fuel flow to the engine, the pressure in the chamber is lowered thereby to interrupt the flow of fuel through the nozzle. Thus a pilot quantity of fuel is allowed to flow to the associated engine. The pressure in the chamber 32 is then allowed to rise once again to the pressure required to open the valve member in the nozzle and the main quantity of fuel flows to the engine.

The reduction in pressure is achieved by a device which operates in a similar manner to the piston 34 and as will be seen from FIG. 3, a further bore 60 opens into the chamber 32 and in the further bore is located a piston 61 which has an enlarged head for engagement with the end wall 36 of the chamber. The head is provided with a recess 62 and opening onto the end wall of the chamber at a position to communicate with the recess, is a passage 63 controlled by a valve 64. The valve 64 has a direct connection with the chamber 32 and the valve member of the valve is held in the closed position by energising a solenoid 65. The piston 61 is biased by a spring 66 into contact with the end wall of the chamber and the recess 62 when the valve head is in contact with the end wall 36, communicates by way of passages in the piston, with a restriction 67.

In operation, prior to the inward movement of the pumping plunger 26 the pistons 34 and 61 will have their respective heads in contact with the end wall 36 and all the solenoids will be energised. As the pumping plunger moves inwardly and the port 30 is covered, fuel will start to flow past the valve 43 and in order to start the delivery of fuel, the solenoid 48 is de-energised allowing the valve 43 to close. The pessure in the chamber 32 then rises to a value sufficient to open the valve member in the nozzle 29 and flow of fuel to the engine takes place. Very soon after the start of delivery of fuel the solenoid 65 is de-energised to allow the valve 64 to open. The pressure in the chamber 32 is therefore communicated to the recess 62 and the piston 61 starts to move away from the end wall 36. As soon as this takes place the communication of the recess 62 with the drain by way of the restriction 67, is broken. The piston 61 however does continue to move and this causes a reduction in the pressure in the chamber 32 sufficient to allow the valve member in the injection nozzle to close and therefore to halt the flow of fuel to the associated engine. The piston 61 has a limited movement and it absorbs a predetermined volume of fuel. When the piston 61 engages the end of the bore so that its movement is halted, the pressure in the chamber 32 again rises causing further delivery of fuel to the associated engine. The flow of fuel continues until the solenoid 42 is de-energised to terminate delivery of fuel. The allowed movement of the piston 61 can be varied using an adjustable stop not shown. This can be in the form of a fluid pressure operable piston the control pressure applied to which can be varied in accordance with the speed and/or quantity of fuel being supplied to the associated engine.

The fact that the recess 62 in the piston 61 has its communication with the drain broken more or less as soon as the piston 61 starts to move, prevents escape of fuel at high pressure to the drain. It will be understood that the modification of the apparatus to provide pilot injection of fuel can be applied to the apparatus of FIG. 2.

FIGS. 1–3 of the drawings show the apparatus as one for supplying fuel to a single injection nozzle. The apparatus may however be of the so-called distributor pump type in which a single plunger or plungers deliver fuel to a number of nozzles in turn. This is readily achieved as shown in FIG. 4 by using a rotary distributor member 70 provided in the usual way with a transverse bore 71 in which is a pair of plungers 72 movable inwardly by cam lobes on a surrounding cam ring not shown. The pumping chamber defined between the plungers may be directly connected to a delivery passage or groove opening onto the periphery of the distributor member so as to register in turn with Outlets 74 Only one of which is shown, formed in a surrounding body, the outlets being connected to the injection nozzles of the associated engine. The pumping chamber is connected to the chamber 32 and to a source of fuel under pressure by way of a non-return valve 75. It is however desirable that the delivery passage 73 and the outlet with which it communicates should be out of communication with the chamber 32 during the initial inward movement of the plungers until the valve 50 is closed. This can be achieved by using the arrangement of FIG. 2 by connecting th delivery passage 73 by way of a passage 76 with a port opening into the end wall 36 of the chamber, the port being positioned so that it is closed off from the chamber 32 by the head 53 of the valve member 51 until the valve member has moved to start delivery of fuel by operation of the valve 55.

I claim:

1. A fuel pumping apparatus for supplying fuel to an internal combustion engine comprising a reciprocable plunger pump operable in use to deliver fuel in timed relationship with the associated engine, a chamber communicating with a pumping chamber of the pump, a bore opening into said chamber and a piston member slidable in the bore, an outlet through which fuel displaced from the pumping chamber can flow to the associated engine, resilient biasing means biasing the piston towards an end wall of the chamber, a recess defined between said end wall and the end of said piston when the latter is in contact with the end wall, first electrically operable means operable to place said recess in communication with said chamber thereby to allow the pressure of fuel in said chamber to drive the piston out of said chamber, a valve member having a head for co-operation with a seating defined about a bore extending from the chamber for controlling the escape of fuel from said chamber, said head being located in the chamber so that it will be pressure actuated into contact with the seating and being tapered to narrow towards the seating and being located so that pressure from said pumping chamber acts on said head to maintain said head in contact against the seating when the valve member is closed, and an electromagnetic device which when energized maintains the head of the valve member away from the seating for controlling the operation of said valve member, the arrangement being such that at the start of a delivery stroke of said pumping plunger, said piston will be in contact with said end wall and said valve member will be open, closure of said valve member will cause delivery of fuel through the outlet and later operation of said first electrically operated means will allow outward movement of the piston, the piston movement absorbing further fuel displaced by the plunger.

2. An apparatus according to claim 1 in which said head is engageable with said end wall of the chamber, the head and said end wall when the head is in contact therewith, defining a recess, said second electrically operated means comprising a valve operable to place said recess in communication with the chamber when it is desired to effect movement of the valve head into contact with the seating.

3. An apparatus according to claim 2 in which said outlet connects with said chamber by way of a passage opening into said chamber at apposition so that the outlet is isolated from said chamber until the head starts to move towards the seating.

4. An apparatus according to claim 3 including a distributor member operable to connect said passage with a plurality of outlets in turn.

5. An apparatus according to claim 1 including a further bore opening into the chamber, a further piston member slidable in the bore and third electrically operable means for controlling the movement of said further piston member, said third electrically operable means being operable after closure of said valve means to absorb a limited quantity of the fuel displaced by the plunge thereby to interrupt the supply of fuel through the outlet.

* * * * *